US007863839B2

(12) United States Patent
Schuricht et al.

(10) Patent No.: US 7,863,839 B2
(45) Date of Patent: Jan. 4, 2011

(54) FAN SPEED CONTROL SYSTEM

(75) Inventors: Scott Richard Schuricht, Edwards, IL (US); Douglas I. Norman, Washington, IL (US); Paul W. Peresta, Dunlap, IL (US); Arvil Duane Wilson, Pekin, IL (US)

(73) Assignee: Caterpillar Inc, Peoria, IL (US)

( * ) Notice: Subject to any disclaimer, the term of this patent is extended or adjusted under 35 U.S.C. 154(b) by 949 days.

(21) Appl. No.: 11/729,920

(22) Filed: Mar. 30, 2007

(65) Prior Publication Data

US 2008/0238607 A1 Oct. 2, 2008

(51) Int. Cl.
*H02P 1/00* (2006.01)
*G05B 11/42* (2006.01)

(52) U.S. Cl. ..... 318/268; 318/280; 318/463; 318/609; 62/178; 123/41.12; 236/35

(58) Field of Classification Search ..... 318/266, 318/280, 283, 254, 466, 471, 472, 463, 609, 318/610, 268; 62/178; 417/22, 42, 43; 236/35; 123/41.12, 41.49
See application file for complete search history.

(56) References Cited

U.S. PATENT DOCUMENTS

| | | | | |
|---|---|---|---|---|
| 4,124,001 | A * | 11/1978 | Samuel et al. | 123/41.12 |
| 4,479,532 | A | 10/1984 | Watanabe | |
| 4,828,088 | A | 5/1989 | Mohan et al. | |
| 4,874,072 | A | 10/1989 | Mohan et al. | |
| 6,079,536 | A | 6/2000 | Hummel et al. | |
| 6,328,000 | B1 | 12/2001 | Hawkins et al. | |
| 6,481,388 | B1 | 11/2002 | Yamamoto | |
| 6,571,751 | B2 | 6/2003 | Vogt | |
| 6,772,714 | B2 | 8/2004 | Laird et al. | |
| 6,779,981 | B2 | 8/2004 | Huang et al. | |
| 6,824,362 | B2 * | 11/2004 | Dodson, III | 417/22 |
| 6,894,883 | B2 | 5/2005 | Buchholz | |
| 7,424,806 | B2 * | 9/2008 | Tien et al. | 62/178 |
| 2002/0066422 | A1 | 6/2002 | Hawkins et al. | |
| 2006/0037334 | A1 * | 2/2006 | Tien et al. | 62/178 |
| 2006/0096554 | A1 | 5/2006 | Shiozaki | |

FOREIGN PATENT DOCUMENTS

| | | |
|---|---|---|
| EP | 1 002 361 B1 | 2/1999 |
| EP | 1450061 | 8/2004 |

* cited by examiner

*Primary Examiner*—Paul Ip
(74) *Attorney, Agent, or Firm*—Finnegan, Henderson, Farabow, Garrett & Dunner LLP; Carl E. Myers

(57) ABSTRACT

A fan speed control system for a machine is disclosed. The control system may include a fan to provide a flow of coolant to the machine. The system may further include a first sensor configured to generate a first signal indicative of an operational parameter of the machine, a second sensor associated with the fan to generate a second signal indicative of an actual speed of the fan, and a controller communicatively coupled to the fan, the first sensor, and the second sensor. The controller may be configured to generate a third signal indicative of a desired fan speed based on the first signal, and a fourth signal indicative of a difference between the desired fan speed and the actual fan speed. The controller may drive the fan based on the third signal and the fourth signal.

17 Claims, 2 Drawing Sheets

FAN SPEED CONTROL SYSTEM

BACKGROUND

Mobile machines, such as, for example, on- or off-highway vehicles; and stationary machines, such as engines, generators, electronic appliances, etc., typically generate a substantial amount of heat during operation. The heat, if not properly dealt with, can reduce fuel efficiency and/or cause damage to machine components. As such, machines typically include cooling systems to move the heat away from the machine during operation. The cooling systems may include, among other things, a fan configured to draw heat away from, and/or push cooling airflow toward machine components.

Due to varying environmental conditions, it may be beneficial to run the fan at a variable speed. For example, an on-highway truck hauling a load up a steep incline on a hot summer day may require more cooling than the same truck idling at a stop on a cold winter day. To the extent it may be necessary and/or efficient to run the fan at a high speed under the former circumstance, it may be unnecessary and/or inefficient to run the fan at the same high speed under the later circumstance. As such, there is a need to regulate the speed of the fan in response to changing environmental conditions.

An attempt at controlling fan speed in response to environmental conditions is described by U.S. Pat. No. 6,238,000 (the '000 patent) issued to Hawkins et al. on Dec. 11, 2001. Specifically, the '000 patent describes a fan speed control system including a plurality of sensors disposed about a vehicle to measure inlet air temperature, engine oil temperature, engine coolant temperature, and transmission oil sump temperature. The sensors provide a fan request signal to a controller, which continually determines a reference fan speed in response to the signal. The controller then compares the reference fan speed to an actual fan speed, by way of a feedback loop, and generates an error signal. The error signal is used to drive the fan.

Although the system of the '000 patent may sufficiently control the fan speed, it may be inefficient for various reasons. First, since the control system drives the fan in response to any error signal, the control system may continually adjust the fan speed, which may be inefficient and unnecessary. Second, because the error signal is based on a difference between the reference fan speed and the actual fan speed, the control system may drive the fan to a maximum possible speed if the fan sensor fails and/or actual fan speed cannot be detected for some other reason. In other words, if the detected fan speed is zero, a maximum error signal may be generated and used to drive the fan. This may cause the fan to reach a maximum speed and provide more cooling than necessary given the circumstances, which may be inefficient. Further, driving the fan to a maximum possible speed may damage the fan, the means used to drive the fan, or other components of the control system.

The fan speed control system of the present disclosure is directed to overcoming one or more of the problems set forth above.

SUMMARY OF THE INVENTION

One aspect of the present disclosure is directed to a fan control system for a machine. The fan control system may include a fan to provide a flow of coolant to the machine. The system may further include a first sensor configured to generate a first signal indicative of an operational parameter of the machine, a second sensor associated with the fan to generate a second signal indicative of an actual speed of the fan, and a controller communicatively coupled to the fan, the first sensor, and the second sensor. The controller may be configured to generate a third signal indicative of a desired fan speed based on the first signal, and a fourth signal indicative of a difference between the desired fan speed and the actual fan speed. The controller may drive the fan based on the third signal and the fourth signal.

Another aspect of the present disclosure is directed to a method of controlling the speed of a fan in a machine. The method may include receiving a first signal indicative of an operational parameter of the machine and receiving a second signal indicative of an actual speed of the fan. The method may further include generating a third signal indicative of a desired fan speed based on the first signal, and a fourth signal indicative of a difference between the desired fan speed and the actual fan speed. The method may also include driving the fan based on the third signal and the fourth signal.

DETAILED DESCRIPTION

Figure 1:
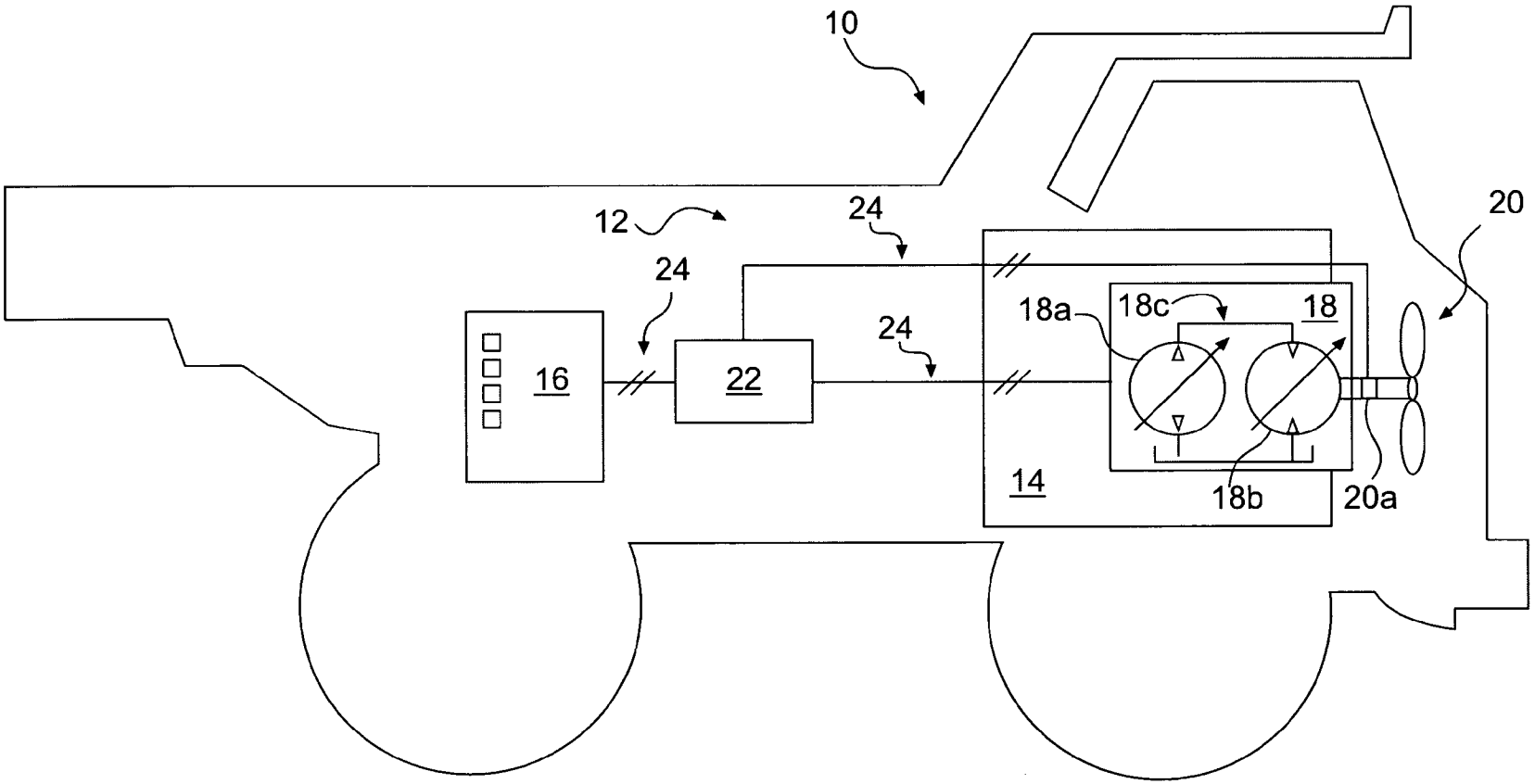
FIG. 1 is schematic representation of an exemplary disclosed fan control system.

FIG. 1 illustrates a machine 10 including an exemplary fan control system 12. Machine 10 may include any mobile or stationary machine that generates heat during operation and benefits from cooling airflow. For example, machine 10 may be a passenger vehicle, an excavating machine, an aircraft, a marine vessel, a locomotive, an electrical generator or motor, or any other suitable machine. Machine 10 may include a main power source 14 to, among other things, propel and/or power other operations of machine 10. For example, power source 14 may be a diesel engine, a gasoline engine, a natural gas engine, a fuel cell, a motor, or any other suitable power source.

Fan control system 12 may be a standalone system or a subsystem of an overall machine cooling system (not shown). System 12 may include one or more sensors 16, a means 18 for driving a fan 20, and a controller 22. Controller 22 may be communicatively coupled to sensors 16, means 18 and/or any other components or systems of machine 12 by way of communication links 24 to, among other things, affect the fan control algorithm of FIG. 2.

Sensors 16 may be disposed about machine 12 in a plurality of locations to detect one or more operational parameters thereof. For example, sensors 16 may measure an inlet manifold air temperature, a hydraulic sump temperature, a transmission oil temperature, an engine coolant temperature, an engine oil temperature, a cabin temperature, or any other desired temperature of interest. Sensors 16 may alternatively or additionally measure pressures, volumes, and/or any other operational parameters, if desired. Each of sensors 16 may generate an output signal indicative of a value of the respective measured parameter (e.g., 170° F., 1.7 atm, etc.).

In one embodiment, means 18 may comprise a variable-displacement pump 18*a* drivingly connected to a hydraulic motor 18*b* by way of a hydraulic circuit 18*c*. Power source 14 may be operable to drive pump 18*a* a given number of strokes per rotation of power source 14. Motor 18*b* may be coupled to drive fan 20 a given number of rotations per volume of fluid displaced by pump 18*a* per stroke. Pump 18*a* may include, for example, one or more actuators (not shown) that regulate a displacement of pump 18*a* (e.g., a volume of fluid displaced into the hydraulic circuit 18*c*) in response to a fan speed command signal (e.g., an electrical current signal) provided by controller 22. As such, fan speed may be a function of a speed of power source 14 and a displacement of pump 18*a*. Therefore, during operation, a change in fan speed may be affected by regulating pump displacement. Thus, one or both of pump 18*a* and motor 18*b* may have displacements responsive to a fan speed command signal provided by controller 22, if desired.

In another embodiment, means 18 may include an electric generator/motor (not shown) arranged to rotate fan 20 in response to a fan speed command signal (e.g., a electrical current signal) provided by controller 22. Still further, means 18 may alternatively comprise a hydraulic, electromagnetic, or mechanical clutch assembly (not shown) driven by power source 14. Engagement and disengagement of the clutch assembly, and thus, fan speed, may be regulated by a fan speed command signal provided by controller 22. However, it is to be appreciated that means 18 may comprise any other suitable driving arrangement known in the art, if desired.

Fan 20 may include one or more single, multiple, and/or variable speed radial and/or axial fans known in the art for generating a flow of air. Alternatively, fan 20 may be any other suitable electrically, hydraulically, electro-hydraulically, or mechanically actuated device which operates to provide coolant (e.g., air flow) to and/or to draw heat from one or more machine components. Fan 20 may include a sensor 20*a* to provide a feedback signal indicative of an actual speed of fan 20 to controller 22 during operation. For example, sensor 20*a* may include a magnetic pickup-type sensor, a variable reluctance type sensor, and optical sensor, and/or or any other suitable sensor known to those skilled in the art. During operation, sensor 20*a* may detect fan rotation and generate a corresponding real time signal in response. As such, in one aspect, the actual fan speed signal may have a frequency component proportional to the actual speed (RPM) of fan 20.

Fan operation may be regulated by controller 22. Controller 22 may include, for example, an electronic control module (ECM), or another processor capable of executing, and/or or outputting command signals in response to received and/or stored data to affect, among other things, the fan control algorithm illustrated in FIG. 2. Controller 22 may include computer-readable storage, such as read-only memories (ROM), random-access memories (RAM), and/or flash memory; secondary storage device(s), such as a tape-drive and/or magnetic disk drive; microprocessor(s) (CPU), and/or any other components for running an application. The microprocessor(s) may comprise any suitable combination of commercially-available or specially-constructed microprocessors for controlling system operations in response to operator input. As such, controller 22 may include instructions and/or data stored as hardware, software, and/or firmware within the memory, secondary storage device(s), and/or microprocessor (s). Alternatively or additionally, controller 22 may include and/or be associated with various other suitably arranged hardware and/or software components. For example, controller 22 may further include power supply circuitry, signal conditioning circuitry, solenoid driver circuitry, amplifier circuitry, timing circuitry, filtering circuitry, switches, and/or other types of circuitry, if desired.

Controller 22 may include one or more maps stored in the computer-readable medium containing predetermined data to facilitate fan speed determinations in connection with the fan speed control algorithm disclosed below. The maps may be, for example, data storage structures such as arrays matrices, tables, etc. The predetermined data may be based on known machine specifications, fan control system specifications, pump specifications, motor specifications, performance test results, etc. For example, controller 22 may include a fan speed map indexed by power source rotation speed (e.g., 500 RPM, 750 RPM, 1,000 RPM, 1,250 RPM, etc.). Each cell of the map may contain a minimum achievable fan speed and a maximum achievable fan speed for the respective power source speed.

Controller 22 may also include one or more predetermined gain maps to facilitate adjustments to fan speed in connection with the algorithm disclosed below. For example, the gain maps may be indexed according to a difference between desired fan speed and actual fan speed (e.g., +/−50, +/−100 RPM, etc.), and a difference between a desired number of fan rotations and an actual number of fan rotations (e.g., +/−800, +/−1,200 rotations), a difference between an actual fan acceleration rate and a desired fan acceleration rate (e.g., +/−100 RPM/s, +/−200 RPM/s). The gain maps may also be indexed according to power source speed (RPM), as mentioned above. However, it is to be appreciated that the gain maps may be indexed according to other parameters, if desired.

One or more predetermined gain components may be indexed into the gain maps. In one embodiment, the gain maps may contain values corresponding to at least one of a proportional gain component $K_p$, an integral gain component $K_i$, and a derivative gain component $K_d$ (i.e., a "PID" gain). The proportional gain component may correspond to a gain applied to remedy a present difference between actual fan speed and a desired fan speed (e.g., present fan speed=1,450 RPM, present desired fan speed=1,500 RPM). The integral gain component may correspond to a gain applied to remedy the results of historical differences between actual fan speed and desired fan speed (e.g., fan 20 has completed 890 less actual revolutions than desired), or "drift." The derivative gain component may correspond to a gain applied to remedy a difference between a present actual fan acceleration and present desired fan acceleration (e.g., fan is accelerating at 50 RPM/s less than desired). However, it is to be appreciated that greater, fewer, or different gain components may be included in the maps, if desired.

Based on the parameter value signals provided by sensors 16 and the actual fan speed signal provided by fan speed sensor 20*a*, controller 22 may determine a fan demand and reference the maps stored in the computer readable memory to generate a corresponding fan demand signal. In response, controller 22 may generate a desired fan speed signal, a nominal desired fan speed signal, a difference signal, an offset fan speed signal, and an adjusted fan speed signal during operation. It is to be appreciated that the signals referred to herein may include analog current and/or voltage signals, encoded digital signals, or any other suitable signals representing the various values of interest. For example, these signals may each comprise a fixed- or variable-frequency, pulse width modulated (PWM) square wave current and/or voltage signal in which a duty cycle thereof determines a speed to which fan 20 may be driven (e.g., substantially proportional or inversely proportional to duty cycle). Alternatively or additionally, each signal may comprise fixed- and/or variable-frequency voltage and/or current signal in which an amplitude thereof determines a speed to which fan 20 is driven (e.g., substantially proportional or inversely proportional to amplitude). However, it is to be appreciated that the signals referred to herein may comprise any suitable signals used to accomplish the disclosed fan control algorithm.

The fan demand signal may indicate, for example, a percentage of a total cooling capacity of system 12 demanded under the circumstances. In one aspect, controller 22 may compare the parameter value signals received from each of sensors 16 to predetermined maps contained in the computer readable storage. Based on the comparison, controller 22 may return a fan request value falling between a minimum request and a maximum request and being indicative of an amount of cooling cumulatively needed by the respective components associated with each of sensors 16 (e.g., low-high, 1-10, 0%-100%, etc.). Based on the fan request values, controller 22 may determine a percentage of the total cooling capacity of system 12 demanded under the circumstances (e.g., 75%), and generate a corresponding fan demand signal. It is contemplated that under some circumstances, system 12 may naturally provide more or less cooling capacity than necessary based on a given demand. For example, design specification tolerances (e.g., over- or under-designing of system 12) may result in minor cooling capacity mismatches. As such, controller 22 may automatically tailor the fan demand signal (e.g., augment or attenuate demand) based on predetermined specifications to account for such tolerances, if desired.

The desired fan speed signal may represent a fan speed that provides adequate cooling to machine 10 under a given set of circumstances, according to the sensed operational parameters and the predetermined maps stored in the computer readable storage of controller 22. For example, during operation controller 22 may look up, reference, or otherwise retrieve a minimum achievable fan speed and a maximum achievable from the map(s) mentioned above, based on a current power source speed (e.g., 2,200 RPM). Controller 22 may then interpolate a desired fan speed, between the minimum and maximum speeds, based on the fan demand signal (e.g., 1,250 RPM). Controller 22 may then generate a desired fan speed signal indicative of the desired fan speed. However, it is to be appreciated that another method of determining a desired fan speed may be used alternatively or additionally, if desired.

The nominal desired fan speed signal may embody the desired fan speed signal augmented, attenuated, modulated, converted, or otherwise adjusted as to provide a signal in a form suitable to drive fan 20. For example, controller 22 may interpolate, retrieve, or otherwise determine a value between a minimum value and a maximum value based on the minimum and maximum achievable fan speeds, the desired fan speed signal, and/or the tables in the computer readable storage (e.g., duty cycle percentage, a gain, etc.). In one aspect, the nominal desired fan speed may comprise the desired fan speed signal pulse width modulated (PWM) based on the value (e.g., duty cycle percentage). Alternatively or additionally, the nominal desired fan speed signal may comprise the desired fan speed signal augmented or attenuated by the value (e.g., a gain). However, it is to be appreciated that the nominal fan speed signal may include any type of signal generated based on the desired fan speed signal and used to drive fan 20 by way of means 18.

It is to be appreciated that extreme changes in environmental conditions may correspond to a drastic increase in desired fan speed. For example, if machine 10 travels from downhill terrain immediately to steep uphill terrain, a great increase in fan speed may be desired if power source 14 speed, transmission fluid temperature, engine oil temperature, etc., quickly increase in response to the load. However, a desired fan speed signal indicating a large increase in fan speed in a short period of time may cause damage to means 18 (e.g., pump valves) and/or fan 20. As such, controller 22 may include a protective fan acceleration limit (e.g. 500 RPM/s) in the computer readable storage, which may be autonomously imposed on the desired fan speed signal. Alternatively or additionally, the limit may be imposed on any of the other signals mentioned above at any step(s) in the algorithm of FIG. 2 discussed below.

The difference signal may represent a difference between the desired fan speed signal and the actual fan speed signal (e.g., desired fan speed less actual fan speed). The offset signal may comprise the difference signal after augmentation, attenuation, modulation, and/or other adjustment based on one or more predetermined values designed to compensate for differences between the desired fan speed and the actual fan speed (e.g., $K_p$, $K_i$, and/or $K_d$, as discussed above). For example, the offset signal may be represented by Eq. 1 below:

$$O(t) = K_p e(t) + \frac{K_i}{T_i}\int e(t)dt + K_d T_d \frac{de(t)}{dt}, \qquad \text{Eq. 1}$$

wherein O(t) is the offset signal, e(t) is the difference signal, $K_p$ is the proportional gain component, $K_i$ is the integral gain component, and $K_d$ is the derivative gain component, $T_i$ is the time of integration (i.e., a predetermined historical period of time), $T_d$ is the time of differentiation (i.e., a predetermined present period of time).

Therefore, during operation controller 22 may continually sample, track and/or store operational data in a database (not shown) contained in the computer-readable storage to facilitate calculation of the offset signal, O(t), based the other signals described above. For example, the tracked operational data may include actual fan speed, desired fan speed, power source speed, a difference between actual fan speed and desired fan speed, a difference between a desired number of total fan rotations and an actual number of total fan rotations, a difference between desired fan acceleration and actual fan acceleration, and/or any other operational data of interest, time-indexed for each sample taken by controller 22. Further, controller 22 may look up, reference, or otherwise retrieve one or more of the gain component values ($K_p$, $K_i$, and/or $K_d$) in the map(s) mentioned above to determine a real-time value of the offset signal, O(t), during operation. In another embodiment, controller 22 may generate the offset signal by modulating or otherwise adjusting the difference signal based on the predetermined values stored in the computer readable storage. Alternatively, another method known in the art to generate an offset signal may be used.

It may be undesirable, for efficiency reasons, to continually adjust fan speed in response to minor changes in actual fan speed. As such, controller 22 may generate an offset signal only when a difference between the actual fan speed and the desired fan speed falls outside a certain predetermined range stored in the computer readable storage (e.g., +/−150 RPM). The predetermined range may be defined such that nominal variations in actual fan speed within the range may have little effect on overall machine efficiency. Further, the predetermined range may be designed such that adjusting the fan speed when it is within the predetermined range may have an efficiency cost greater than an efficiency gain that may be realized by achieving a more ideal actual fan speed.

The adjusted fan speed signal may embody the nominal desired fan speed signal added to or otherwise combined with the offset signal, which may be used to correctively drive the fan as to remedy differences between the actual fan speed and the desired fan speed. In one aspect, controller 22 may apply the adjusted fan speed signal to means 18 to drive fan 20 in response thereto, as mentioned above. Particularly, for a given adjusted fan speed signal, pump **18*a* may displace a predetermined amount of fluid per stroke, the amount being based on laboratory testing and/or performance specifications for the particular pump 18***a*. Similarly, if means 18 comprises a generator/motor or a clutch assembly, a predetermined amount of current or friction, respectively, may be generated or applied for a given adjusted fan speed signal.

Communication links 24 may include any suitable combination of wired and/or wireless non-proprietary links and/or proprietary links known in the art. Further, the communications and signals referred to herein may be executed according to any protocols based on known industry standards, such as, for example, SAE J1587, SAE J1939, RS-232, RP1210, RS-422, RS-485, MODBUS, CAN, SAEJ1587, Bluetooth, 802.11b or g, or any other suitable protocol known in the art. Further, the communications may be facilitated by network architecture, such as, for example, a telephone-based network (such as a PBX or POTS), a satellite-based network, a local area network (LAN), a wide area network (WAN), a dedicated intranet, the Internet, and/or any other suitable network architecture known in the art.

Operation of the disclosed fan control algorithm will be discussed further in the following section with reference to FIG. 2.

INDUSTRIAL APPLICABILITY

The disclosed control system may be applicable to any machine that realizes efficiency gains from cooling operation. Particularly, the disclosed control system 12 may improve efficiency by adjusting fan speed only when actual fan speed falls outside a predetermined desired range. Additionally, the disclosed system may be useful in the event a fan speed sensor fails and actual fan speed cannot be detected. Specifically, in such a case, instead of driving the fan with a maximum error signal to a maximum possible speed, which may be inefficient, unnecessary, and/or damaging, the disclosed system may instead drive the fan based on a desired fan speed signal only.

Figure 2:
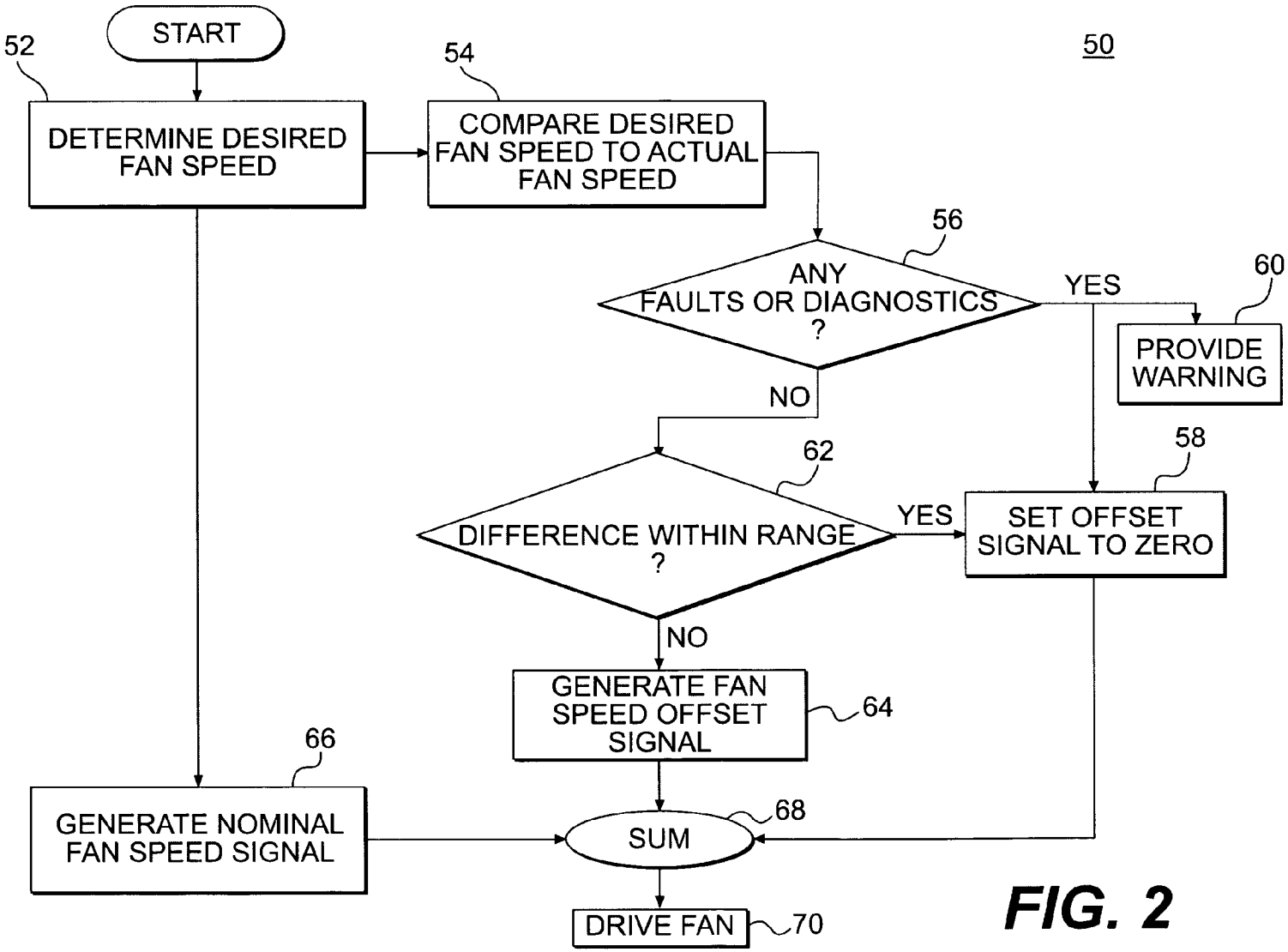
FIG. 2 is a flowchart representing a control algorithm of the exemplary disclosed fan control system of FIG. 1.

Referring to FIG. 2, during machine operation, controller 22 may autonomously implement fan control algorithm 50. Initially, controller 22 may determine a desired fan speed (step 52). That is, based on the parameter value signals provided by sensors 16, controller 22 may generate a fan demand signal indicative of a desired portion of the total cooling capacity of system 12, as discussed above. Controller 22 may then convert, map, or otherwise translate the fan demand signal into a desired fan speed (e.g., 1,350 RPM). Conversion may include interpolating a desired fan speed between a minimum achievable fan speed and a maximum achievable fan speed given a current speed of power source 14 and/or pump 18*a* or motor 18*b* displacement ranges, according to predetermined data contained in the computer readable storage.

It is to be appreciated that certain environmental conditions may result in an actual fan speed greater or less than the desired fan speed for a given amount of displaced fluid or applied current. For example, in a case where driving means 18 comprises a hydraulic pump 18*a* and motor 18*b*, a given amount of power input to pump 18*a* and/or motor 18*b* may drive fan 20 to different actual speeds depending on the temperature of the fluid in the hydraulic circuit (i.e., temperature may have an effect on the viscosity of the fluid, etc.). Similarly, in a case where driving means 18 comprises an electric motor, and certain components thereof, such as windings, are cold, an impedance of the windings may be less than when the windings are hot. As such, a given amount of power may drive fan 20 to different actual speeds, depending on the temperature of the windings. Likewise, if driving means 18 includes a clutch assembly, actual fan speed may vary depending on the amount of clutch wear, slip, etc. It is to be appreciated, however, that other environmental factors, such as, for example, fan loading, ambient air temperature, humidity, machine travel speed, wind speed, etc., may cause the actual fan speed to be different than the desired fan speed. As such, controller 22 may compare the desired fan speed to the actual fan speed and determine a difference therebetween (step 54). For example, controller 22 may convert a frequency of the actual fan speed signal generated by sensor 20*a* to fan rotations per minute (RPM). Controller 22 may subsequently generate a difference signal corresponding to a difference between the desired fan speed signal and the actual fan speed signal. The difference signal may then be equated to an offset amount of fluid or current to be added to or subtracted from the amount corresponding to the desired speed.

Controller 22 may then determine if any faults or diagnostic flags have been identified (step 56). For instance, in this step controller 22 may determine if the actual fan speed is greater than a minimum threshold (e.g., zero RPM, a predetermined percentage of the desired fan speed, etc.). It is to be appreciated that, in the event that sensor 20*a* fails or actual fan speed cannot be detected for another reason, the actual fan speed detected by controller 22 may be zero or significantly lower than expected. As such, the difference signal may indicate a larger discrepancy between the actual fan speed and the desired fan speed than there may be in reality. Similarly, if means 18 and/or fan 20 encounter an extreme load, or otherwise malfunction during operation, actual fan speed may decrease drastically, and additional power applied in an attempt to remedy the difference between desired fan speed and actual fan speed may be futile, if not damaging.

Therefore, if controller 22 determines that fault(s) and/or diagnostic flag(s) have been identified, controller 22 may make no adjustment to fan speed. For instance, if the actual fan speed detected is zero and/or less than another predetermined threshold (indicating some type of malfunction), controller 22 may make no adjustment to fan speed. That is, controller 22 may generate no offset signal and/or set the offset signal to zero (step 58). It is to be appreciated that setting the offset signal to zero may be achieved by way of an open circuit, grounding, a "0" digital value, etc.

Concurrently with step 58, controller 22 may provide a warning to a machine operator (step 60). For example, the warning may include the illumination of a "check engine" light, a cooling system error light, a fan system error light, the sounding of an alarm, and/or any other suitable warning known in the art. Alternatively or additionally, controller 22 may indicate a fan system fault in a machine operation log or the like stored in the computer-readable storage media.

Conversely, if controller 22 determines that no faults or diagnostic flags have been detected (e.g., the actual fan speed is greater than the minimum threshold) during completion of step 56, controller 22 may determine if a difference between the desired fan speed and the actual fan speed falls within the predetermined range discussed above (e.g., +/−150 RPM) (step 62). If the actual fan speed falls within the predetermined range (i.e., actual fan speed is sufficiently close to the desired fan speed), controller 22 may make no adjustment to fan speed. That is, controller 22 may generate no offset signal and/or set the offset signal to zero (step 58) as discussed above.

However, if the actual fan speed falls outside the predetermined range, controller 22 may generate a corrective offset signal to remedy differences between the desired and actual fan speeds (step 64). For example, in one embodiment, controller 22 may look up, retrieve, or otherwise select at least one of the proportional, integral, and integral gain components (e.g., $K_p$, $K_i$, and/or $K_d$) from the stored matrices based on the sampled parameters, as discussed above. Controller 22 may apply the at least one gain component to the difference signal to generate the offset signal according to Eq. 1. Alternatively or additionally, controller 22 may apply any other gain, or otherwise augment, attenuate, modulate, and/or otherwise adjust the difference signal to account for differences between desired fan speed and actual fan speed, if desired.

Concurrently with step 52, controller 22 may generate a nominal desired fan speed signal based on the desired fan speed signal, as discussed above (step 66). As discussed above, this may include augmenting, attenuating, modulating, and/or otherwise adjusting the desired fan speed signal as to provide a corresponding signal of a form suitable to drive fan 20. Subsequently, controller 22 may generate an adjusted fan speed signal by adding, summing, or otherwise combining the offset signal to the nominal desired fan speed signal (step 68), and drive fan 20 with the adjusted fan speed signal (step 70). In this manner, fan 20 may be correctively driven as to remedy differences between desired fan speed and actual fan speed, as discussed above. In other words, fan 20 may be driven such that actual fan speed approaches the desired fan speed.

It is to be appreciated that if the offset signal has been set to zero in step 58, the adjusted fan speed signal may be based only on the nominal desired fan speed signal. That is, the adjusted fan speed signal may be equal to the nominal desired fan speed signal (i.e., adjusted fan speed signal=nominal desired fan speed signal+offset signal (zero)). In this manner, controller 22 may drive fan 20 only to a speed attainable under the circumstances with the nominal desired fan speed signal as input to driving means 18, rather than to a maximum possible speed. Further, it is to be appreciated, that in driving the fan, controller 22 may autonomously impose the predetermined protective fan acceleration limit (e.g., 500 RPM/s) on any of the signals and/or in any of the control steps mentioned above.

By implementing the disclosed system and algorithm to control the speed of a cooling fan, efficiency gains may be realized. Particularly, because the offset and desired fan speed signals may both be used to drive the fan, the fan may be driven only to a speed attainable under the circumstances with the nominal desired fan speed as input, rather than to a maximum speed responsive to a maximum error signal, in the event of a speed sensor failure. Further, by adjusting the fan speed only when it falls outside a predetermined range, the control system may make adjustments to fan speed only when necessary, rather than continuously. Apart from improving efficiency, these provisions may also prevent undue wear and/or damage to pumps, motors, or other means used to drive the fan, as well as other elements of the control system.

It will be apparent to those skilled in the art that various modifications and variations can be made to the disclosed fan speed control system and/or algorithm. Other embodiments will be apparent to those skilled in the art from consideration of the specification and practice of the disclosed control system and/or algorithm. It is intended that the specification and examples be considered as exemplary only, with a true scope being indicated by the following claims and their equivalents.

What is claimed is:

1. A fan control system, comprising:

a fan to provide a flow of coolant to a machine;

a first sensor configured to generate a first signal indicative of an operational parameter of the machine;

a second sensor associated with the fan to generate a second signal indicative of an actual speed of the fan; and a controller communicatively coupled to the fan, the first sensor, and the second sensor, the controller being configured to:

generate a third signal indicative of a desired fan speed based on the first signal;

generate a fourth signal indicative of a difference between the desired fan speed and the actual fan speed; and drive the fan based on the third signal and the fourth signal;

wherein generating the third signal includes:

determining a maximum achievable fan speed and a minimum achievable fan speed based on a current speed of a power source associated with the machine; and interpolating a desired fan speed between the minimum achievable fan speed and the maximum achievable fan speed based on the first signal.

2. The system of claim 1, wherein driving the fan based on the third signal and the fourth signal includes:

generating a fifth signal by applying at least one gain to the fourth signal; and driving the fan in response to the third signal and the fifth signal.

3. The system of claim 2, wherein the controller is further configured to:

generate the fifth signal only if the difference between the desired fan speed and the actual fan speed falls outside a predetermined range; and set the fifth signal to zero if the actual fan speed falls below a predetermined threshold.

4. The system of claim 2, wherein driving the fan in response to the third signal and the fifth signal includes:

modulating the third signal;

combining the modulated third signal and the fifth signal; and driving the fan based on the combination.

5. The system of claim 2, wherein the at least one gain includes at least one of a proportional gain, an integral gain, and a derivative gain.

6. The system of claim 1, further including a pump and motor coupled to drive to the fan, wherein driving the fan includes regulating a displacement of at least one of the pump and motor based on the third signal and the fourth signal.

7. A method of controlling the speed of a fan, comprising:

receiving a first signal indicative of an operational parameter of a machine;

receiving a second signal indicative of an actual speed of the fan;

generating a third signal indicative of a desired fan speed based on the first signal;

generating a fourth signal indicative of a difference between the desired fan speed and the actual fan speed; and driving the fan based on the third signal and the fourth signal;

wherein generating the third signal includes:

determining a maximum achievable fan speed and a minimum achievable fan speed based on a current speed of a power source associated with the machine; and interpolating a desired fan speed between the minimum achievable fan speed and the maximum achievable fan speed based on the first signal.

8. The method of claim 7, further including:

generating a fifth signal by applying at least one gain to the fourth signal; and driving the fan in response to the third signal and the fifth signal.

9. The method of claim 8, further including:

generating the fifth signal only if the difference between the desired fan speed and the actual fan speed falls outside a predetermined range; and setting the fifth signal to zero if the actual fan speed falls below a predetermined threshold.

10. The method of claim 8, wherein driving the fan in response to the third signal and the fifth signal includes:

modulating the third signal;

combining the modulated third signal and the fifth signal; and driving the fan based on the combination.

11. The method of claim 8, wherein the at least one gain includes at least one of a proportional gain, an integral gain, and a derivative gain.

12. The method of claim 7, wherein driving the fan further includes responsively adjusting a displacement of at least one of a pump and motor coupled to drive the fan based on the third signal and the fourth signal.

13. A machine, comprising:

a power source configured to power operations of the machine;

a fan to provide a flow of coolant to the power source;

a driving element operatively coupled to the power source to drive the fan;

a first sensor configured to generate a first signal indicative of an operational parameter of the power source;

a second sensor associated with the fan to generate a second signal indicative of an actual speed of the fan; and a controller communicatively coupled to the fan, the first sensor, and the second sensor, the controller being configured to:

generate a third signal indicative of a desired fan speed based on the first signal;

generate a fourth signal indicative of a difference between the desired fan speed and the actual fan speed; and drive the fan based on the third signal and the fourth signal;

wherein generating the third signal includes:

determining a maximum achievable fan speed and a minimum achievable fan speed based on a current speed of a power source associated with the machine; and interpolating a desired fan speed between the minimum achievable fan speed and the maximum achievable fan speed based on the first signal.

14. The machine of claim 13, wherein driving the fan based on the third signal and the fourth signal includes:

generating a fifth signal by applying at least one gain to the fourth signal; and driving the fan in response to the third signal and the fifth signal.

15. The machine of claim 14, wherein the controller is further configured to:

generate the fifth signal only if the difference between the desired fan speed and the actual fan speed falls outside a predetermined range; and set the fifth signal to zero if the actual fan speed falls below a predetermined threshold.

16. The machine of claim 14, wherein driving the fan in response to the third signal and the fifth signal includes:

modulating the third signal;

combining the modulated third signal and the fifth signal; and driving the fan based on the combination.

17. The machine of claim 13, further including a pump and motor coupled to drive the fan, wherein driving the fan includes regulating a displacement of at least one of the pump and motor in response to the third signal and the fourth signal.

* * * * *